US008286756B2

(12) United States Patent
Koba et al.

(10) Patent No.: US 8,286,756 B2
(45) Date of Patent: Oct. 16, 2012

(54) ELEVATOR GROUP CONTROL SYSTEM

(75) Inventors: Yoshimasa Koba, Tokyo (JP); Naohiko Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 329 days.

(21) Appl. No.: 12/744,221

(22) PCT Filed: Dec. 20, 2007

(86) PCT No.: PCT/JP2007/074563

§ 371 (c)(1),
(2), (4) Date: May 21, 2010

(87) PCT Pub. No.: WO2009/081464

PCT Pub. Date: Jul. 2, 2009

(65) Prior Publication Data

US 2010/0282544 A1 Nov. 11, 2010

(51) Int. Cl.
*B66B 1/18* (2006.01)

(52) U.S. Cl. ..... 187/382; 187/247

(58) Field of Classification Search ..... 187/247, 187/248, 380–388, 391–393
See application file for complete search history.

(56) References Cited

U.S. PATENT DOCUMENTS

| | | | | |
|---|---|---|---|---|
| 4,691,808 | A | 9/1987 | Nowak et al. | |
| 4,719,996 | A * | 1/1988 | Tsuji | 187/387 |
| 4,901,822 | A * | 2/1990 | Tsuji | 187/386 |
| 4,947,965 | A * | 8/1990 | Kuzunuki et al. | 187/387 |
| 5,250,766 | A * | 10/1993 | Hikita et al. | 187/391 |
| 6,000,504 | A * | 12/1999 | Koh et al. | 187/382 |
| 6,315,082 | B2 * | 11/2001 | Hikita | 187/382 |
| 6,325,178 | B2 * | 12/2001 | Hikita et al. | 187/382 |
| 7,093,693 | B1 * | 8/2006 | Gazdzinski | 187/384 |
| 7,267,202 | B2 * | 9/2007 | Sirag, Jr. | 187/382 |
| 2011/0155515 | A1 * | 6/2011 | Suzuki et al. | 187/382 |

FOREIGN PATENT DOCUMENTS

| | | |
|---|---|---|
| JP | 62 25587 | 6/1987 |
| JP | 63 218484 | 9/1988 |
| JP | 7 117941 | 5/1995 |
| JP | 7 232867 | 9/1995 |
| JP | 2601500 | 4/1997 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An elevator group control system is obtained which is improved in the operating efficiency of entire cars by determining an assigned car with the use of an evaluation value calculated from an increment of the number of floors to be stopped by each car when a hall destination call newly generated by a hall control panel is temporarily assigned to each car. The system includes a hall input unit which is installed in a hall and by which the registration of a destination floor call is able to be made, and an assignment evaluation value calculation unit which includes a plurality of evaluation value calculation units for calculating the respective evaluation values of a plurality of cars in an individual manner, determines a final evaluation value from the respective evaluation values, and selects an optimal assigned car. The assignment evaluation value calculation unit includes a stop number increment evaluation value calculation unit, and the stop number increment evaluation value calculation unit sets an increment variable from an increment of the number of floors to be stopped at the time when a new hall call newly generated and a new hall destination call representing a destination floor of the new hall call are temporarily assigned to each of the plurality of cars, and calculates a stop number increment evaluation value based on the increment variable thus set.

7 Claims, 5 Drawing Sheets

ELEVATOR GROUP CONTROL SYSTEM

TECHNICAL FIELD

The present invention relates to an elevator group control system which manages a plurality of elevators in an efficient manner.

BACKGROUND ART

In general, in cases where a plurality of elevators are generally installed in a building, an elevator group control system is applied in order to manage a plurality of elevators in an efficient manner and to shorten passenger's waiting time.

In addition, such a kind of elevator group control system is intended to shorten transportation completion times required to transport passengers to their destination floors, as well as to shorten service completion times, while permitting some extension of passenger's waiting times.

A conventional elevator group control system is provided, as an optimal assignment device for car calls, with a call registration unit to register a passenger's destination floor call together with a hall call, and a maximum number determination unit to determine a maximum number of car calls to be assigned to each car, these units being arranged in each elevator hall, wherein in cases where the maximum number of car calls for a car is exceeded, the exceeded car calls are assigned to another car or cars, so that the number of stopping floors up to each passenger's destination floor is decreased to achieve the shortening of the service completion time (for example, see a first patent document).

FIG. 5 is an explanatory view showing an assignment operation according to the conventional system described in the first patent document, wherein a case is illustrated in which cars 3A-3C of a plurality of elevators #A-#C are installed in a building having floors 1F-10F as service floors.

In FIG. 5, for example, let us assume that in cases where a hall call 5A has been generated on the floor 4F and destination floor calls 6A, 6B to the floors 5F, 6F have been generated, this call has been assigned to the car 3A based on priorities such as arrival prediction time evaluation values.

In addition, let us assume that thereafter, in the car 3B, car calls 7A, 7B to the floors 4F, 10F have been registered, and a hall destination call 8 to the floor 10F has newly been generated on the floor 4F.

In this case, there occurs a phenomenon in which although it is already decided that the car 3B is scheduled to stop at the floors 4F and 10F, the new hall destination call 8 has not been assigned to the car 3B but to the car 3A.

That is, if a "maximum number" for the number of stops permitted to the car 3A is "4", new calls will be assigned to the car 3A until the number of stops of the car 3A amounts to "4", as a result of which when the destination floor call of the hall call 8 newly generated on the floor 4F is for "the floor 10F", it is assigned to the car 3A.

[First Patent Document] Japanese patent application laid-open No. S63-218484

DISCLOSURE OF THE INVENTION

Problems to be Solved by the Invention

The conventional elevator group control system involves the following problem. That is, when one car is assigned to a destination floor call from a certain hall, a destination floor call newly generated at a hall, which will be more efficient if assigned to another car depending on the destination floor thereof, is assigned to that one car until the number of destination floors of the car to be stopped amounts to a predetermined value, as a result of which it is impossible to achieve efficient operation to a sufficient extent.

The present invention has been made to solve the aforementioned problems, and has for its object to obtain an elevator group control system which is able to achieve efficient operation to a sufficient extent by selecting and assigning an optimal car each time a new hall destination call is generated, while suppressing the number of stopping floors of each car.

Means for Solving the Problems

An elevator group control system which carries out operation management of a plurality of cars according to the present invention includes a hall input unit which is installed in one or more halls and by which the registration of a destination floor call is able to be made, and an assignment evaluation value calculation unit which includes a plurality of evaluation value calculation units for calculating the respective evaluation values of a plurality of cars in an individual manner, determines a final evaluation value from the respective evaluation values, and selects an optimal assigned car, wherein the assignment evaluation value calculation unit includes a stop number increment evaluation value calculation unit which calculates a stop number increment evaluation value, and the stop number increment evaluation value calculation unit sets an increment variable from an increment of the number of floors to be stopped at the time when a new hall call newly generated and a new hall destination call representing a destination floor of the new hall call are temporarily assigned to each of the plurality of the cars, and calculates the stop number increment evaluation value based on the increment variable thus set.

Effect of the Invention

According to the present invention, an assigned car is determined by the use of an evaluation value which is calculated from an increment of the number of floors to be stopped by each car at the time when a hall destination call newly generated by a hall control panel is temporarily assigned to each car, as a result of which it is possible to improve the operation efficiency of the entire plurality of cars.

BEST MODE FOR CARRYING OUT THE INVENTION (First Embodiment)

Figure 1:
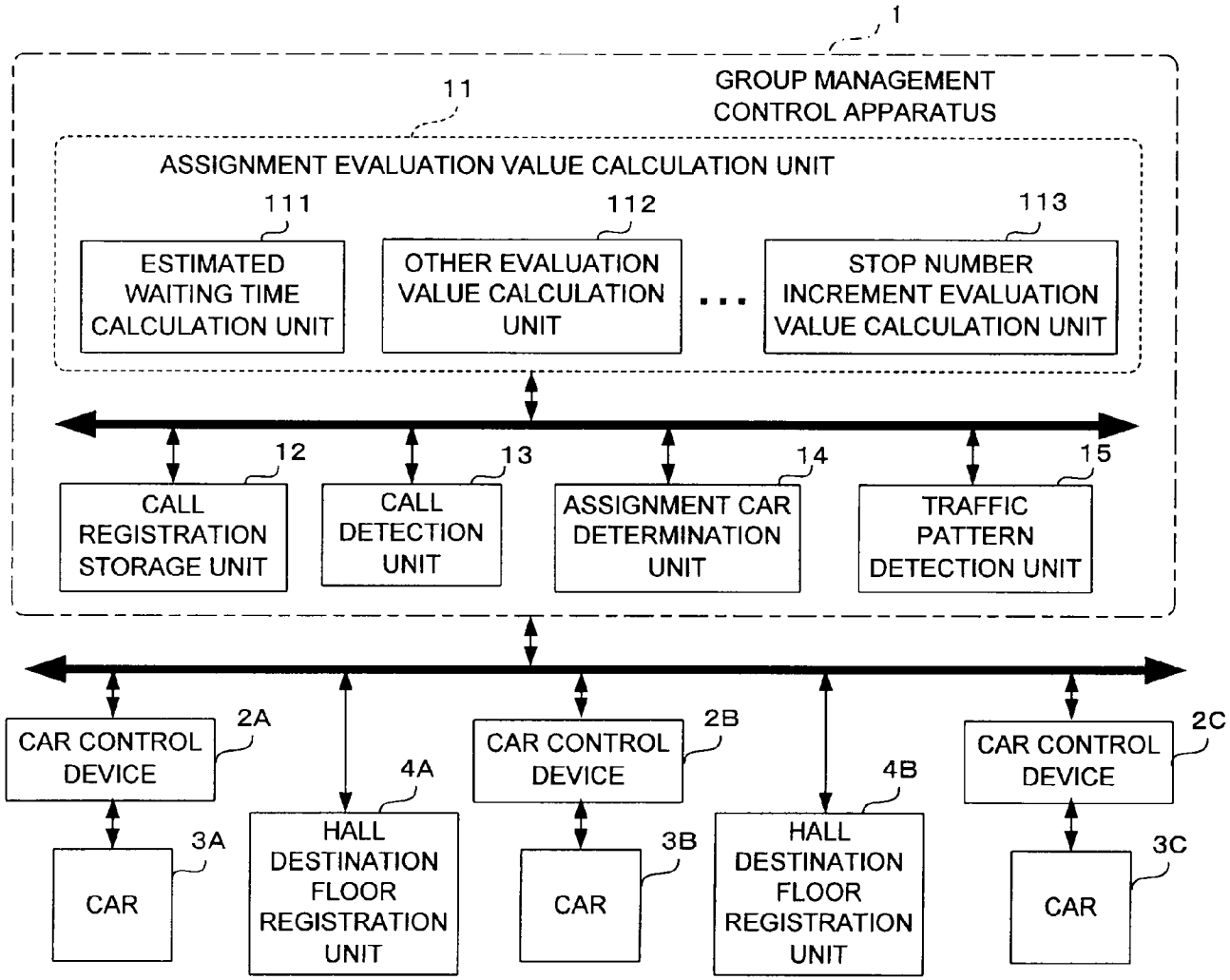
FIG. 1 is a block diagram showing an elevator group control system according to a first embodiment of this invention. (First Embodiment)

FIG. 1 is a block diagram showing an elevator group control system according to a first embodiment of this invention, wherein a case is shown in which cars 3A-3C of a plurality of elevators are installed in a building. Although the case in which three sets of cars 3A-3C are installed is shown here as an example, it goes without saying that an arbitrary number of cars can be installed.

In FIG. 1, car control devices 2A-2C for individually controlling the respective cars 3A-3C and hall destination floor registration units 4A, 4B installed in each hall are connected to a group management control apparatus 1.

The car control devices 2A-2C are provided for the individual cars 3A-3C installed in the building, respectively, and serve to respectively control a plurality of elevators under the control of the group management control apparatus 1.

The hall destination floor registration units 4A, 4B together constitute a hall input unit (hall control panel) for enabling the registration of a destination floor call (transmission of registration information on a destination floor) in a hall, and have an operation key such as a ten-key numeric pad or the like and a display panel. When a hall call and its destination floor call (hall destination call) are generated in a hall, the hall destination floor registration units 4A, 4B display the number of an optimal car assigned by the group management control apparatus 1, and inform the user (passenger) of the car to be ridden.

The group management control apparatus 1 is provided with an assignment evaluation value calculation unit 11, a call registration storage unit 12, a call detection unit 13, an assignment car determination unit 14, and a traffic pattern determination unit 15, and performs the processing of assigning the hall destination call to the optimal car. The respective units 11-15 in the group management control apparatus 1 are mutually connected to one another.

The assignment evaluation value calculation unit 11 is provided with an estimated waiting time calculation unit 111, an other evaluation value calculation unit 112, and a stop number increment evaluation value calculation unit 113.

The stop number increment evaluation value calculation unit 113 is a component element that is a characteristic requirement added by the first embodiment of the present invention, and the estimated waiting time calculation unit 111 and the other evaluation value calculation unit 112 are component elements that are used in a conventional system.

In the group management control apparatus 1, the call determination unit 13 detects a hall destination call generated in the hall destination floor registration units 4A, 4B in which the registration of a destination floor call can be made, and inputs the hall call and its destination floor call newly generated to the assignment evaluation value calculation unit 11.

The assignment evaluation value calculation unit 11 calculates an assignment evaluation value from the current assigned hall calls and the car calls registered in the individual cars 3A-3C based on the stored content of the call registration storage unit 12.

The assignment car determination unit 14 determines an optimal car for assignment of a newly generated hall destination call based on the calculated results of the assignment evaluation values of the individual cars 3A-3C.

The group management control apparatus 1 inputs an instruction to that one of the car control devices 2A-2C of the individual elevators which has been determined by the assignment car determination unit 14, so that one of the cars 3A-3C corresponding to that one of the car control devices 2A-2C is made to respond to that hall destination call.

Figure 2:
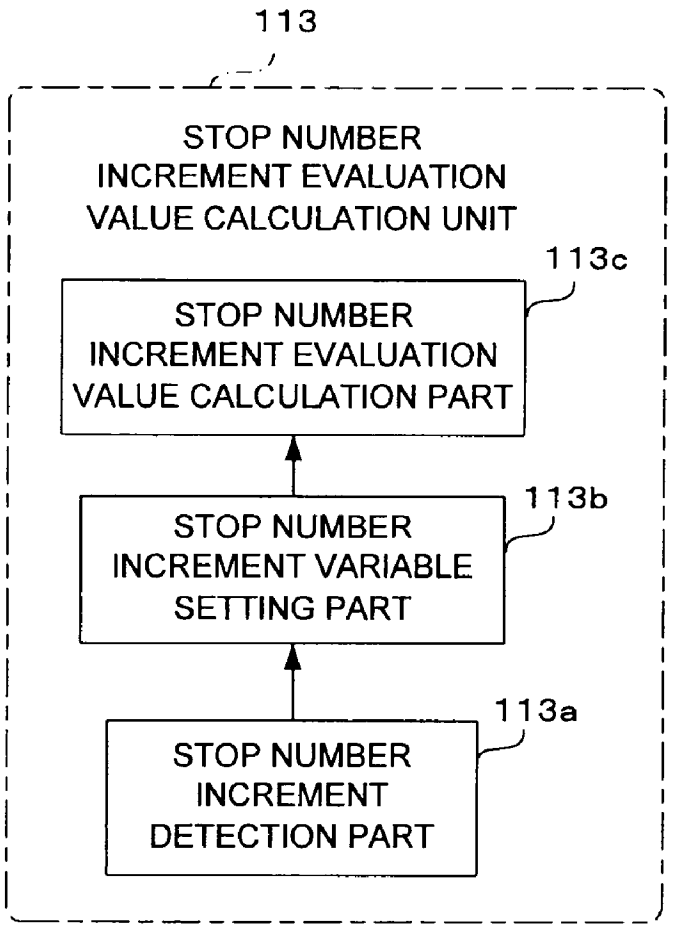
FIG. 2 is a block diagram specifically showing a stop number increment evaluation value calculation unit in an assignment evaluation value calculation unit according to the first embodiment of the present invention. (First Embodiment)

FIG. 2 is a block diagram specifically showing the stop number increment evaluation value calculation unit 113 in the assignment evaluation value calculation unit 11.

In FIG. 2, the stop number increment evaluation value calculation unit 113 is provided with a stop number increment detection part 113*a*, a stop number increment variable setting part 113*b*, and a stop number increment evaluation value calculation part 113*c*.

The stop number increment detection part 113*a* detects an increment of the number of stops for each of the cars 3A-3C at the time when a new hall call and its destination floor call are temporarily assigned to the individual cars 3A-3C based on the registered hall calls assigned to the individual cars 3A-3C and the car calls registered for the individual cars 3A-3C.

The stop number increment variable setting part 113*b* sets an increment variable based on a predetermined function with an argument of an increment of the number of floors to be stopped which has been detected by the stop number increment detection part 113*a*.

In addition, the stop number increment evaluation value calculation part 113*c* calculates a stop number increment evaluation value for each of the individual cars 3A-3C based on the increment variable set by the stop number increment variable setting part 113*b*.

Next, reference will be made to a processing operation according to the first embodiment of the present invention shown in FIG. 1 and FIG. 2, while referring to a flow chart of FIG. 3.

Figure 3:
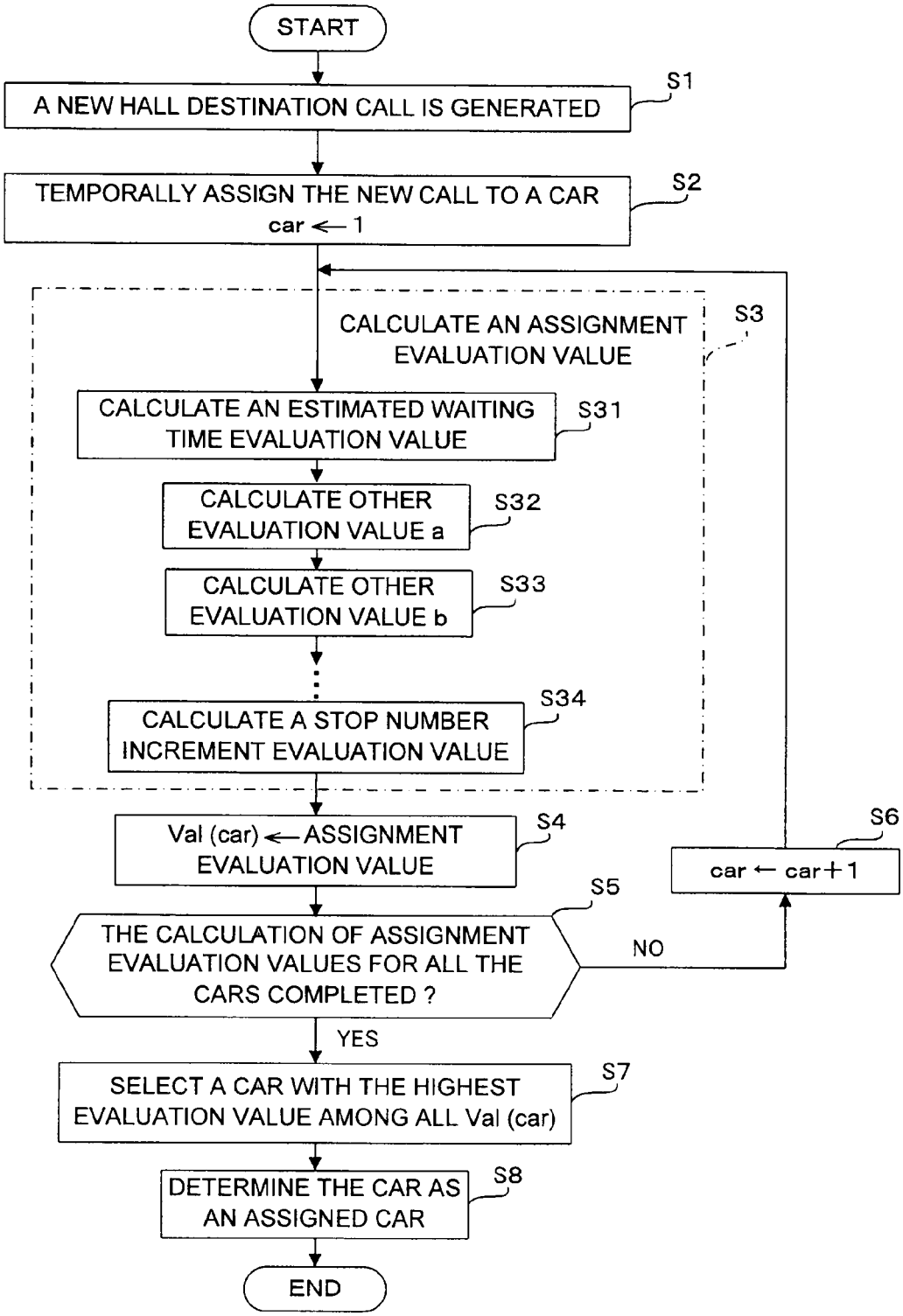
FIG. 3 is a flow chart showing a processing operation according to the first embodiment of the present invention. (First Embodiment)

In FIG. 3, first, when a new hall destination call is generated in a hall (step S1), the group management control apparatus 1 temporarily assigns the new hall destination call to the car 3A (car=1) (step S2).

Subsequently, the assignment evaluation value calculation unit 11 calculates an assignment evaluation value at the time of assigning the new hall destination call to the car 3A (step S3).

Specifically, in step S3, an estimated waiting time is calculated by the estimated waiting time calculation unit 111 (step S31), and other evaluation values a, b are calculated by the other evaluation value calculation unit 112 (steps S32, S33). At the same time, the stop number increment evaluation value is calculated by the stop number increment evaluation value calculation unit 113 (step S34), and a value obtained by totaling a plurality of evaluation values is calculated as an assignment evaluation value for the temporarily assigned car 3A.

Subsequently, the assignment evaluation value calculated in step S3 is set as an assignment evaluation value Val (1) of the temporarily assigned car 3A (step S4), and it is determined whether the calculation of assignment evaluation values for all the cars 3A-3C (cars=1, 2, 3) installed in the building has been completed (step S5).

In step S5, if it is determined that the calculation of the assignment evaluation values has not yet been completed (i.e., NO), a temporary assigned car is changed to the car 3B (car=1+1) (step S6), and the calculation processing of the assignment evaluation values (step S3) is carried out.

On the other hand, in step S5, if it is determined that the calculation of the assignment evaluation values has been completed (i.e., YES), a car with the smallest evaluation value (corresponding to an increment of the number of stops) among all the cars of the assignment evaluation values Val is elected (step S7).

Finally, the car thus elected in step S7 is determined as an optimal assigned car with respect to the new hall destination call (step S8), and the processing routine of FIG. 3 is ended.

Next, more specific reference will be made to the calculation processing of the stop number increment evaluation value according to the stop number increment evaluation value calculation unit 113.

The stop number increment evaluation value is an evaluation value that is calculated in consideration of an increment of the number of floors to be stopped in cases where a new hall destination call is temporarily assigned to each of the cars 3A-3C based on the registration status of hall calls and car calls already registered for the individual cars 3A-3C and the new hall destination call newly generated.

The number of stops at the time when a new hall destination call has been generated may be increased by "1" at a hall, and also may be incremented by "1" at a destination floor, so it can be incremented by "2" at the maximum.

However, the increment is set to "1" in cases where it is determined that either one of a boarding hall or a destination floor is to be stopped at by means of a hall call or a car call already registered. In addition, the increment is set to "0" in cases where it is already determined that both a boarding hall and a destination floor are to be stopped at.

An example of calculating an evaluation value by the use of the above-mentioned conditions with respect to the increment of the number of stops will be given as follows.

First, a stop number increment evaluation value V1 is calculated according to the following formula (1) by the use of a weighting coefficient W1, a total number of scheduled stops A after temporarily assigning a new hall destination call, and a total number of scheduled stops B before temporarily assigning the new hall destination call.

$$V1=W1\times(A-B) \tag{1}$$

Here, note that in formula (1) above, the weighting coefficient W1 is a coefficient which defines an evaluation distribution in the case of making a comprehensive evaluation based on other evaluation values.

In addition, a stop number increment evaluation value V2, which takes into consideration a further larger increment value of the number of stops, is calculated according to the following formula (2) by the use of a weighting coefficient W2 based on a power value which is obtained by squaring a difference between the total numbers of scheduled stops (A−B).

$$V2=W2\times(A-B)\hat{}2 \tag{2}$$

Moreover, a stop number increment evaluation value V3, which takes into consideration not only the increment value but also the numbers of already registered hall calls and car calls, is calculated according to the following formula (3) by the use of a weighting coefficient W3 based on a difference between the squares of the individual total numbers of scheduled stops (A^2−B^2).

$$V3=W3\times(A\hat{}2-B\hat{}2) \tag{3}$$

By replacing the difference between the total numbers of scheduled stops (A−B) in formula (2) and formula (3) above with D, formula (2) and formula (3) are represented as shown in the following formulas (4) and (5), respectively.

$$V2=W2\times D\hat{}2 \tag{4}$$

$$V3=W3\times(D\hat{}2+2\times D\times B) \tag{5}$$

Here, in cases where the range of adjustment by the weighting coefficient K2 in the stop number increment evaluation value V2 calculated according to formula (4) above is small, and the range of adjustment by the weighting coefficient K3 in the stop number increment evaluation value V3 calculated according to formula (5) above is large, it can be considered to further change formula (5).

In this case, the stop number increment evaluation value V4 is calculated by the following formula (6) by using the weighting coefficient W4, a predetermined coefficient K and a total number of service floors S in the building.

$$V4=W4\times(D\hat{}2+K\times D\times B/S) \tag{6}$$

In formula (6) above, the total number of service floors S is the number of floors which the individual cars 3A-3C can stop in the building.

That is, even with the same increment value, the degree of influence of the increment value changes according to the total number of service floors S in the building, so it is necessary to perform division by the total number of service floors S, as shown in formula (6). By doing so, it is possible to suppress the degree of influence in cases where the total number of service floors S is large.

Incidentally, in general, in a building, there takes place, as a certain kind of traffic pattern, a standard traffic pattern in which many people get into elevators from a floor having an entrance, for example at the start of working hours, to go to their individual office floors.

In this case, in order to improve the transportation efficiency, it is necessary to make each elevator convey as many passengers as possible and return to the entrance floor for a short time after having conveyed passengers, so it becomes important to suppress the increment of the number of stops.

On the contrary, at the time of leaving the offices (i.e., at the end of working hours), there takes place a standard traffic pattern in which various people get in the elevators from upper floors to go to the entrance floor, with almost all passengers generating no car calls to get off on floors on the way.

In this case, even if a hall call is generated from any floor, a destination floor thereof is the same (entrance floor), so even if the hall call is assigned to any car, there will be no difference in the increment of the number of stops. Accordingly, it is better to put weight on other evaluation values such as an estimated waiting time evaluation value calculated by the estimated waiting time calculation unit 111, rather than the stop number increment evaluation value calculated by the stop number increment evaluation value calculation unit 113.

As a consequence, the group management control apparatus 1 detects a current traffic pattern by means of the traffic pattern detection unit 15, and the stop number increment evaluation value calculation unit 113 sets the weighting coefficients W1 through W4 in the above-mentioned formulas (1)-(6) for evaluation value calculation in a variable manner according to the traffic pattern thus detected.

That is, the stop number increment evaluation value calculation unit 113 in the group management control apparatus 1 sets the weighting coefficients W1 through W3 to large values at the start of working hours thereby to strengthen the degree of influence due to an increment of "1" of the number of stops, and on the contrary, sets the weighting coefficients W1 through W3 to small values at the end of working hours thereby to weaken the degree of influence due to an increment of "1" of the number of stops, whereby efficient operation can be achieved in accordance with the change of the traffic pattern.

Figure 4:
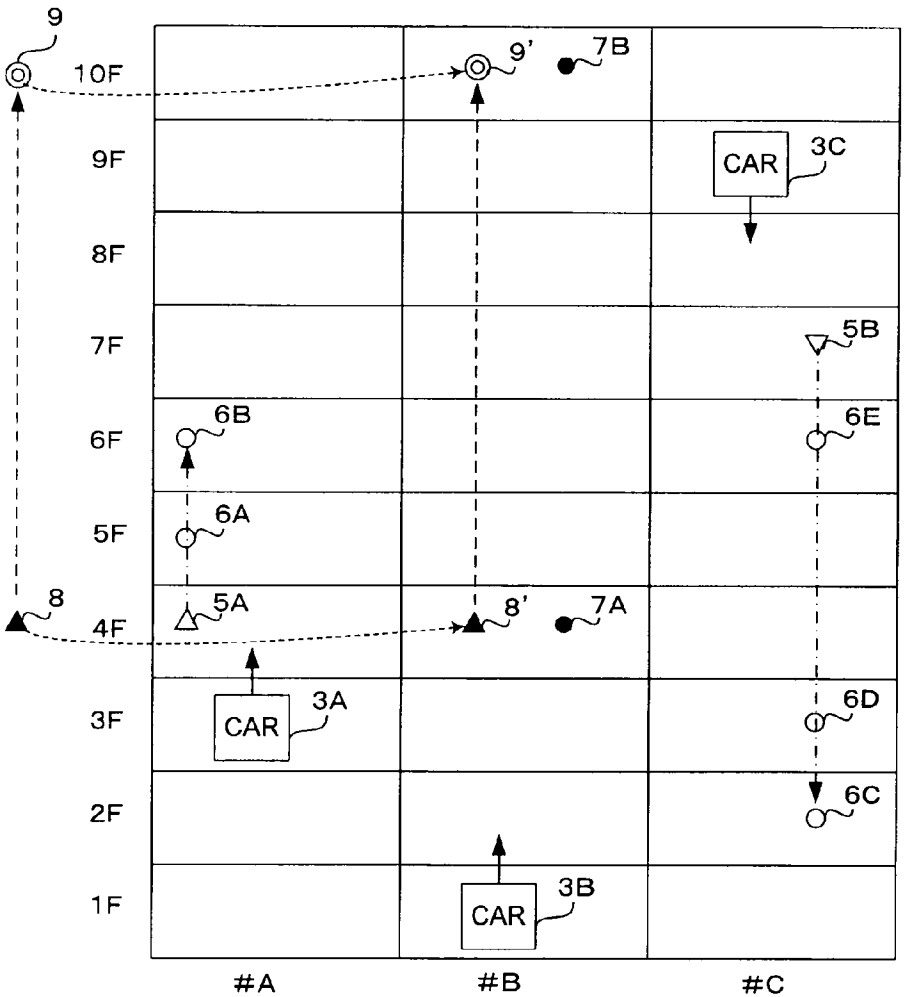
FIG. 4 is an explanatory view showing car assignment processing by the use of stop number increment evaluation values according to the first embodiment of the present invention. (First Embodiment)
Figure 5:
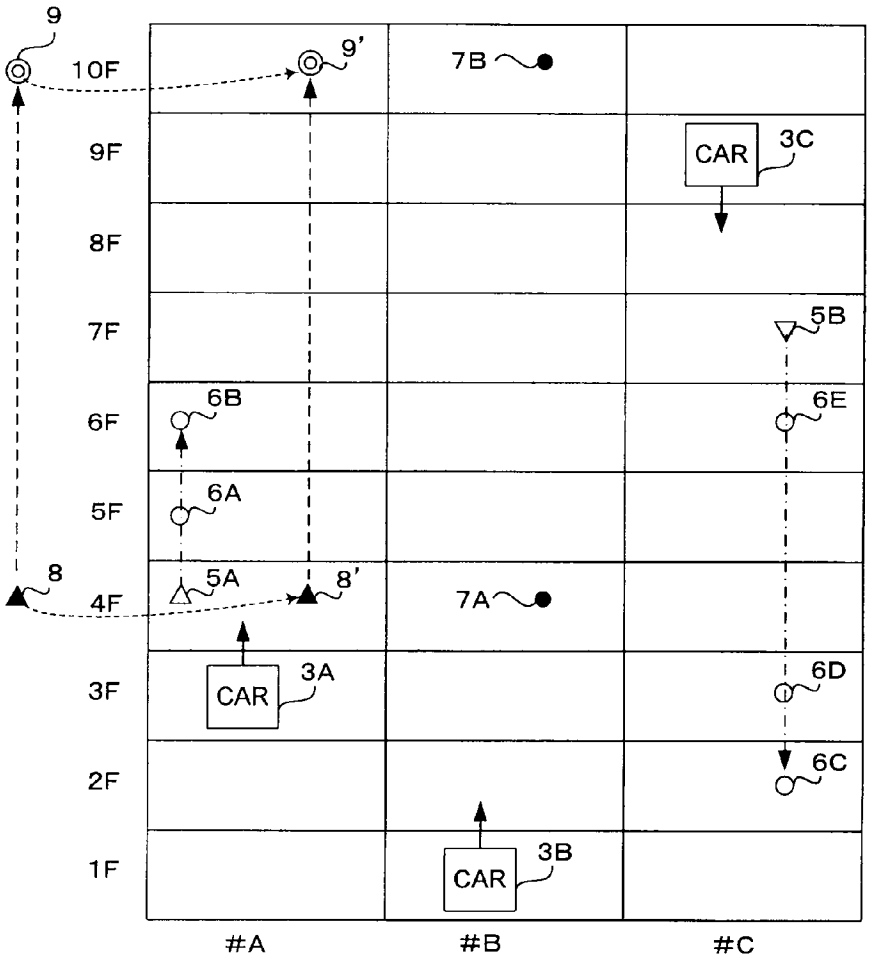
FIG. 5 is an explanatory view showing an assignment operation according to a conventional elevator group control system.

FIG. 4 is an explanatory view showing car assignment processing by the use of stop number increment evaluation values according to the first embodiment of the present invention. In FIG. 4, those which are similar to the aforementioned ones (see FIG. 5) are denoted by the same reference numerals and characters as those in the aforementioned ones, while omitting a detailed explanation thereof. Although here is shown a case in which the present invention is applied as an example to the building with the floors 1F-10F being made to serve as service floors, the invention can also be applied to a building with an arbitrary number of floors.

Similarly as stated above, first of all, in cases where a car call with destination floor registrations to the fifth and sixth floors 5F, 6F is made on the fourth floor 4F, it is assigned to the car 3A with the highest evaluation value among the cars 3A-3C.

Subsequently, let us assume the case in which after car calls to the fourth and tenth floors 4F, 10F have been registered in the car 3B, a hall call 8 and its destination floor call 9 are to be newly registered.

At this time, when the new hall call 8 and its destination floor call 9 are assigned to the car 3A, the number of stops is incremented by "1", and when it is assigned to the car 3B, the increment of the number of stops is "0", and when it is assigned to the car 3C, the number of stops is incremented by "2".

The group management control apparatus 1 calculates stop number increment evaluation values based on the above-mentioned increments of the number of stops by means of the stop number increment evaluation value calculation unit 113, and in cases where the assignment evaluation value VA of the car 3A and the assignment evaluation value VB of the car 3B are reversed (VA>VB), the new hall call 8 and the destination floor call 9 are assigned to the car 3B, as shown in a broken line arrow in FIG. 4.

As described above, the elevator group control system which manages or controls the operation of the plurality of cars 3A-3C according to the first embodiment of the present invention is provided with the hall input unit (the hall destination floor registration units 4A, 4B) which is installed in one or more halls and by which destination floor call registration is able to be made, and the assignment evaluation value calculation unit 11 which includes a plurality of evaluation value calculation units (the estimated waiting time calculation unit 111, and the other evaluation value calculation unit 112) for calculating the respective evaluation values of the plurality of cars 3A-3C in an individual manner, determines a final evaluation value from the respective evaluation values, and selects an optimal assigned car.

The assignment evaluation value calculation unit 11 includes the stop number increment evaluation value calculation unit 113 which calculates a stop number increment evaluation value, and the stop number increment evaluation value calculation unit 113 sets an increment variable from an increment of the number of floors to be stopped at the time when a new hall call newly generated and a new hall destination call representing a destination floor of the new hall call are temporarily assigned to each of the plurality of cars 3A-3C, and calculates the stop number increment evaluation value based on the increment variable thus set.

The stop number increment evaluation value calculation unit 113 includes the stop number increment detection part 113*a* that detects the increment of the number of floors to be stopped, the stop number increment variable setting part 113*b* that sets the increment variable based on a predetermined function with the increment thus detected as an argument, and the stop number increment evaluation value calculation part 113*c* that calculates the stop number increment evaluation value based on the increment variable thus set.

The stop number increment evaluation value calculation unit 113 calculates the stop number increment evaluation value V1 of each of the individual cars 3A-3C by using, as the increment variable, an increment value (A−B=D) which is obtained by subtracting a second total number of scheduled stops B before the temporal assignment of the new hall destination call from a first total number of scheduled stops A after the temporal assignment of the new hall destination call (see formula (1)).

In addition, the stop number increment evaluation value calculation unit 113 calculates the stop number increment evaluation value V2 of each of the individual cars 3A-3C by using, as the increment variable, a power value D^2 which is obtained by raising to a predetermined power an increment value D which is calculated by subtracting a second total number of scheduled stops B before the temporal assignment of the new hall destination call from the first total number of scheduled stops A after the temporal assignment of the new hall destination call (see formula (2) and formula (4)).

Moreover, the stop number increment evaluation value calculation unit 113 calculates the stop number increment evaluation value V3 of each of the individual cars 3A-3C by using, as the increment variable, an increment value (A^2-B^2) which is obtained by subtracting a second power value which is calculated by raising to a predetermined power a second total number of scheduled stops B before the temporal assignment of the new hall destination call, from a first power value which is calculated by raising to the predetermined value a first total number of scheduled stops A after the temporal assignment of the new hall destination call (see formula (3) and formula (5)).

Further, the stop number increment evaluation value calculation unit 113 calculates the stop number increment evaluation value V4 of each of the individual cars 3A-3C by using, as the increment variable, a value which is obtained by adding a multiplication value to a power value D^2, where the power value D^2 is calculated by raising to a predetermined power an increment value D which is obtained by subtracting a second total number of scheduled stops B before the temporal assignment of the new hall destination call from a first total number of scheduled stops A after the temporal assignment of the new hall destination call, and the multiplication value is calculated by multiplying the second total number of scheduled stops B divided by a total number of service floors S, the increment value D and a predetermined coefficient K with one another (see formula (6)).

Furthermore, the group management control apparatus 1 is provided with the traffic pattern detection unit 15, wherein when calculating the stop number increment evaluation value based on the increment variable, the stop number increment evaluation value calculation unit 113 performs the multiplication of a weighting coefficient W1 through W4 which is set based on the result of detection of the traffic pattern detection unit 15.

That is, a car with a smaller increment as compared with the other cars is already assigned with a floor in which a hall call has been newly generated, and with a call to a destination floor of the hall call (i.e., it has the newly generated hall call and the call to the same destination floor as that of the destination floor call), as a result of which by evaluating an increment of the number of stops at the time when the new hall call and its destination floor call are temporarily assigned to the individual cars 3A-3C, respectively, and adding it to the final evaluation value, and assigning the new hall call to a car with a small evaluation value (increment), the increment of the number of stops (duplicate stops of the entire cars) can be suppressed, and the number of floors to be stopped with respect to the other cars can be decreased.

Accordingly, the number of stopping floors of the entire cars in the group control system can be decreased.

In addition, by selecting assigned cars according to traffic patterns, for example at the start of working hours, an average value of arrival floors due to uppermost floor calls, in which rising cars are reversed, can be suppressed or reduced. As a consequence, the travel distance of the entire cars is decreased, and hence an energy saving effect is obtained. Besides, each elevator can convey as many passengers as possible, and can be made to return to the entrance floor in a short time after having conveyed passengers, thus making it possible to improve the transportation efficiency.

Further, due to the reduction of the number of stopping floors and the travel distance, the round trip time of each of the cars 3A-3C in which each car reciprocates in the building can be shortened, and the generation rate of "long waiting calls" in which passengers continue to wait for the arrival of a car over a long period of time (for example, 60 seconds or more) can be reduced, thereby making it possible to improve the operating efficiency.

The invention claimed is:

1. An elevator group control system which carries out operation management of a plurality of cars, said elevator group control system comprising:

a hall input unit which is installed in one or more halls and by which the registration of a destination floor call is able to be made; and an assignment evaluation value calculation unit which includes a plurality of evaluation value calculation units for calculating the respective evaluation values of said plurality of cars in an individual manner, determines a final evaluation value from said respective evaluation values, and selects an optimal assigned car;

wherein said assignment evaluation value calculation unit includes a stop number increment evaluation value calculation unit which calculates a stop number increment evaluation value; and wherein said stop number increment evaluation value calculation unit sets an increment variable from an increment of the number of floors to be stopped at the time when a new hall call newly generated and a new hall destination call representing a destination floor of said new hall call are temporarily assigned to each of said plurality of cars, and calculates said stop number increment evaluation value based on said increment variable thus set.

2. The elevator group control system as set forth in claim 1, wherein said stop number increment evaluation value calculation unit includes:

a stop number increment detection part that detects said increment of the number of floors to be stopped, a stop number increment variable setting part that sets said increment variable based on a predetermined function with said increment thus detected as an argument, and a stop number increment evaluation value calculation part that calculates said stop number increment evaluation value based on said increment variable thus set.

3. The elevator group control system as set forth in claim 1, wherein said stop number increment evaluation value calculation unit calculates the stop number increment evaluation value of each of said individual cars by using, as said increment variable, an increment value which is obtained by subtracting a second total number of scheduled stops before the temporal assignment of the new hall destination call from a first total number of scheduled stops after the temporal assignment of the new hall destination call.

4. The elevator group control system as set forth in claim 1, wherein said stop number increment evaluation value calculation unit calculates the stop number increment evaluation value of each of the cars by using, as said increment variable, a power value which is obtained by raising to a predetermined power an increment value which is calculated by subtracting a second total number of scheduled stops before the temporal assignment of the new hall destination call from a first total number of scheduled stops after the temporal assignment of the new hall destination call.

5. The elevator group control system as set forth in claim 1, wherein said stop number increment evaluation value calculation unit calculates the stop number increment evaluation value of each of said cars by using, as said increment variable, an increment value which is obtained by subtracting a second power value which is calculated by raising to a predetermined power a second total number of scheduled stops before the temporal assignment of the new hall destination call, from a first power value which is calculated by raising to said predetermined power a first total number of scheduled stops after the temporal assignment of the new hall destination call.

6. The elevator group control system as set forth in claim 1, wherein said stop number increment evaluation value calculation unit calculates the stop number increment evaluation value of each of the cars by using, as said increment variable, a value which is obtained by adding a multiplication value to a power value, where said power value is calculated by raising to a predetermined power an increment value which is obtained by subtracting a second total number of scheduled stops before the temporal assignment of the new hall destination call from a first total number of scheduled stops after the temporal assignment of the new hall destination call, and said multiplication value is calculated by multiplying said second total number of scheduled stops divided by a total number of service floors, said increment value and a predetermined coefficient with one another.

7. The elevator group control system as set forth in claim 1, further comprising:

a traffic pattern detection unit;

wherein when calculating said stop number increment evaluation value based on said increment variable, said stop number increment evaluation value calculation unit performs the multiplication of a weighting coefficient which is set based on the result of detection of said traffic pattern detection unit.

* * * * *